US007367872B2

(12) United States Patent
Donohue

(10) Patent No.: US 7,367,872 B2
(45) Date of Patent: May 6, 2008

(54) CONDITIONER DISK FOR USE IN CHEMICAL MECHANICAL POLISHING

(75) Inventor: Timothy J. Donohue, Menlo Park, CA (US)

(73) Assignee: Applied Materials, Inc., Santa Clara, CA (US)

( * ) Notice: Subject to any disclaimer, the term of this patent is extended or adjusted under 35 U.S.C. 154(b) by 0 days.

(21) Appl. No.: 10/409,888

(22) Filed: Apr. 8, 2003

(65) Prior Publication Data

US 2004/0203325 A1 Oct. 14, 2004

(51) Int. Cl.
*B24B 19/22* (2006.01)

(52) U.S. Cl. ..... 451/72; 451/443; 451/527; 451/529; 451/551

(58) Field of Classification Search ..... 451/21, 451/56, 72, 443, 527, 529, 548, 551
See application file for complete search history.

(56) References Cited

U.S. PATENT DOCUMENTS

| | | | | |
|---|---|---|---|---|
| 3,932,966 | A | 1/1976 | Stern | |
| 4,481,741 | A | 11/1984 | Bouladon et al. | |
| 5,081,051 | A | 1/1992 | Mattingly et al. | |
| 5,216,843 | A | 6/1993 | Breivogel et al. | |
| 5,245,796 | A | 9/1993 | Miller et al. | |
| 5,259,085 | A | 11/1993 | Marafante et al. | |
| 5,456,627 | A | 10/1995 | Jackson et al. | |
| 5,486,131 | A | 1/1996 | Cesna et al. | |
| 5,531,635 | A | 7/1996 | Mogi et al. | |
| 5,569,062 | A | 10/1996 | Karlsrud | |
| 5,626,509 | A | 5/1997 | Hayashi | |
| 5,804,507 | A | 9/1998 | Perlov et al. | |
| 5,839,947 | A | 11/1998 | Kimura et al. | |
| 5,851,138 | A * | 12/1998 | Hempel, Jr. | 451/56 |
| 5,928,071 | A * | 7/1999 | Devlin | 451/547 |
| 5,931,725 | A | 8/1999 | Inaba et al. | |
| 6,019,670 | A | 2/2000 | Cheng et al. | |
| 6,033,290 | A | 3/2000 | Gurusamy et al. | |
| 6,036,583 | A | 3/2000 | Perlov et al. | |
| 6,179,693 | B1 | 1/2001 | Beardsley et al. | |
| 6,200,199 | B1 | 3/2001 | Gurusamy et al. | |
| 6,200,207 | B1 * | 3/2001 | Hsu | 451/443 |
| 6,299,511 | B1 | 10/2001 | Gurusamy et al. | |
| 6,299,522 | B1 * | 10/2001 | Lee | 451/548 |
| 6,325,709 | B1 | 12/2001 | Nanda et al. | |
| 6,390,909 | B2 * | 5/2002 | Foster et al. | 451/444 |
| 6,551,181 | B2 * | 4/2003 | Lee | 451/548 |
| 6,672,949 | B2 * | 1/2004 | Chopra et al. | 451/287 |
| 6,733,370 | B2 * | 5/2004 | Aiyer | 451/56 |
| 6,806,193 | B2 | 10/2004 | Korthuis et al. | |
| 2004/0110453 | A1 * | 6/2004 | Barnett, III | 451/56 |

FOREIGN PATENT DOCUMENTS

EP 0 868 976 A2 7/1998

OTHER PUBLICATIONS

International Search Report and Written Opinion Application Serial No. PCT/US2004/33960, May 11, 2005, 12 pp.

* cited by examiner

*Primary Examiner*—Timothy V. Eley
(74) *Attorney, Agent, or Firm*—Fish & Richardson P.C.

(57) ABSTRACT

A conditioner disk for use on a polish pad in chemical mechanical polishing process includes a base structure a plurality of curved blades supported by the base structure. The blades radiate outwardly from a center region of the base structure and curve in a common direction.

28 Claims, 6 Drawing Sheets

CONDITIONER DISK FOR USE IN CHEMICAL MECHANICAL POLISHING

BACKGROUND

The present invention relates generally to chemical mechanical polishing of substrates, and more particularly to a conditioner disk for use in chemical mechanical polishing.

Integrated circuits are typically formed on substrates, particularly silicon wafers, by the sequential deposition of conductive, semiconductive or insulative layers. After each layer is deposited, the layer is etched to create circuitry features. As a series of layers are sequentially deposited and etched, the outer or uppermost surface of the substrate, i.e., the exposed surface of the substrate, becomes successively less planar. This non-planar outer surface presents a problem for the integrated circuit manufacturer as a non-planar surface can prevent proper focusing of the photolithography apparatus. Therefore, there is a need to periodically planarize the substrate surface to provide a planar surface. Planarization, in effect, polishes away a non-planar, outer surface, whether a conductive, semiconductive, or insulative layer, to form a relatively flat, smooth surface.

Chemical mechanical polishing is one accepted method of planarization. This planarization method typically requires that the substrate be mounted on a carrier or polishing head, with the surface of the substrate to be polished exposed. The substrate is then placed against a rotating polishing pad. The carrier head may also rotate and/or oscillate to provide additional motion between the substrate and polishing surface. Further, a polishing slurry, including an abrasive and at least one chemically reactive agent, may be spread on the polishing pad to provide an abrasive chemical solution at the interface between the pad and substrate.

Important factors in the chemical mechanical polishing process are: substrate surface planarity and uniformity, and the polishing rate. Inadequate planarity and uniformity can produce substrate defects. The polishing rate sets the time needed to polish a layer. Thus, it sets the maximum throughput of the polishing apparatus.

It is important to take appropriate steps to counteract any deterioration of the polishing pad which could present the possibility of either damaging the substrate (such as by scratches resulting from accumulated debris in the pad) or reducing polishing speed and efficiency (such as results from glazing of the pad surface after extensive use). The problems associated with scratching the substrate surface are self-evident. The more general pad deterioration problems both decrease polishing efficiency, which increases cost, and create difficulties in maintaining consistent operation from substrate to substrate as the pad decays.

The glazing phenomenon is a complex combination of contamination, thermal, chemical and mechanical damage to the pad material. When the polisher is in operation, the pad is subject to compression, shear and friction producing heat and wear. Slurry and abraded material from the wafer and pad are pressed into the pores of the pad material and the material itself becomes matted and even partially fused. These effects reduce the pad's roughness and its ability to apply fresh slurry to the substrate.

It is, therefore, desirable to continually condition the pad by removing trapped slurry, and unmatting, re-expanding or re-roughening the pad material. The pad can be conditioned after a number of substrates are polished. The pad can also be conditioned at the same time substrates are polished.

SUMMARY

In one aspect, the invention is directed to a conditioner for use on a polish pad in chemical mechanical polishing process. The conditioner includes a base structure having an axis of rotation and a plurality of curved blades supported by the base structure. The blades radiate outwardly from a center region of the base structure and curve in a common direction.

Implementations of the invention may include one or more of the following features. The base structure may be disk-shaped. The common direction may be counter-clockwise or clockwise as viewed from a side of the base structure with the blades. Adjacent the center region, each blade may be oriented parallel to a corresponding radius extending outwardly from the axis of rotation. At an outer circumference of the conditioner, each blade may be oriented such that the tangential of a surface of the blade forms an angle between about 0° and 60° with a corresponding radius extending outwardly from the axis of rotation. The blades may be distributed at equal angular intervals about the axis of rotation. Adjacent blades of the plurality of blades may form a channel that is narrower near the center region than at an edge of the conditioner. When the conditioner disk rotates in the common direction and the adjacent curved blades contact a surface of the polish pad, the channel between adjacent curved blades may capture slurry in an area near a periphery of the conditioner disk and direct the captured slurry to the center region. When the conditioner disk rotates opposite to the common direction and the adjacent curved blades contact a surface of the polish pad, the channel between adjacent curved blades may expel slurry from the center region and directs the expelled slurry to an area the periphery of the conditioner disk. Each blade may include a bottom surface, a back surface, and a front surface. At least one of the back surface and front surface is inclined. The front surface may incline forward and forms a forward inclination angle or incline backward and forms a backward inclination angle with a reference plane perpendicular to the bottom surface. At least one of the bottom surface, the back surface, and the front surface are coated with a hardening material, such as diamond. An edge between the bottom surface and one of the back surface and the front surface may be chamfered. At least one of the bottom surface, the back surface, and the front surface may be serrated or knurled. An insert tool holder may hold an insert that forms a portion of at least one of the blades.

In another aspect, the invention is directed to a method of conditioning. In the method, a plurality of curved blades supported by a base structure of a conditioner is brought into contact with a polishing surface, and the base structure rotates about an axis of rotation. The blades of the conditioner radiate outwardly from a center region of the base structure and curve in a common direction.

Implementations of the invention may include one or more of the following features. Rotating the base structure may include rotating in the common direction such that a channel between adjacent curved blades captures slurry in an area near a periphery of the conditioner and directs the captured slurry to the center region. Rotating the base structure may include rotating opposite to the common direction such that a channel between adjacent curved blades expels slurry from the center region and directs the expelled slurry to an area the periphery of the conditioner.

Additional advantages of the invention will be set forth in the description which follows, and in part will be obvious from the description, or may be learned by practice of the invention. The advantages of the invention may be realized by means of the instrumentalities and combinations particularly pointed out in the claims.

BRIEF DESCRIPTION OF THE DRAWINGS

The present invention will be understood more fully from the detailed description and accompanying drawings of the invention set forth herein. However, the drawings are not to be construed as limiting the invention to the specific embodiments shown and described herein. Like reference numbers are designated in the various drawings to indicate like elements.

DETAILED DESCRIPTION

A substrate can be polished at a polishing station 25 of chemical mechanical polishing (CMP) apparatus. A description of a suitable CMP apparatus may be found in U.S. Pat. No. 5,738,574, the entire disclosure of which is incorporated herein by reference. Although unillustrated, the CMP apparatus can include multiple polishing stations.

Figure 1:
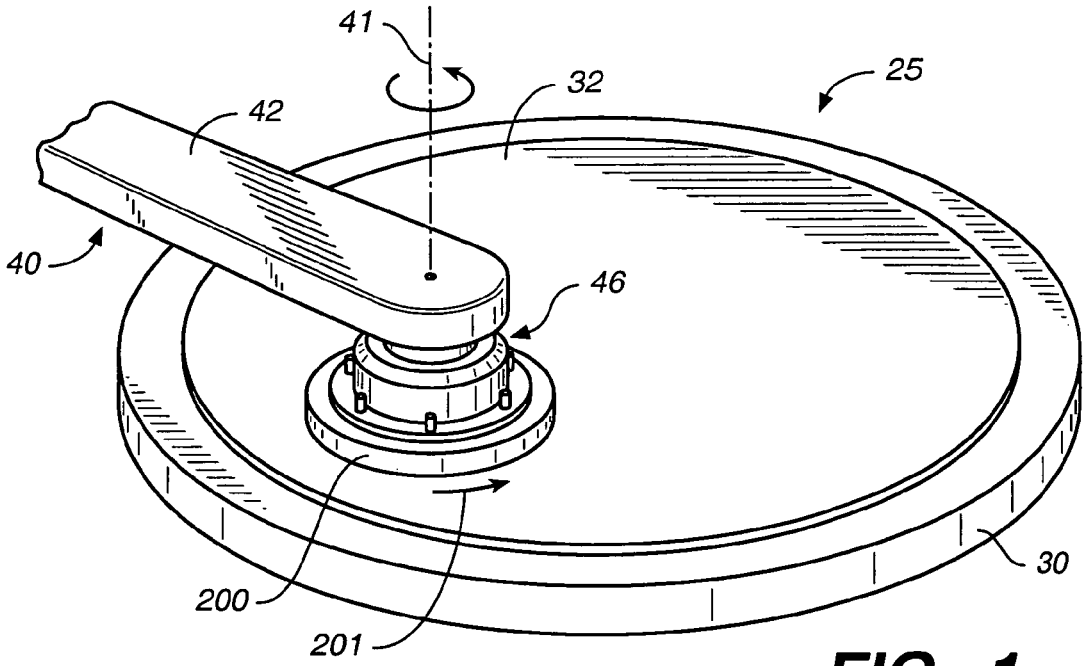
FIG. 1 shows a conditioner head placed on a polishing pad for conditioning the polishing pad with a conditioner disk.

As shown in FIG. 1, the polishing station 25 includes a rotatable platen 30, which supports a polishing pad 32, and a pad conditioner 40. The rotatable platen 30 and the conditioner 40 are both mounted to a machine base of the CMP apparatus. Each pad conditioner 40 includes a conditioner head 46, an unillustrated base, and an arm 42 connecting the conditioner head 46 to the base. The base can pivot to sweep the arm 42 and the conditioner head 46 across the polishing pad surface 36.

Each polishing station 25 also includes a cleaning cup, which contains a cleaning liquid for rinsing or cleaning the conditioner head 46. The arm 42 can move the conditioner head 46 out of the cleaning cup and place the conditioner head 46 atop the polishing pad 32.

The conditioner head 46 includes a conditioner disk 200 that is brought into contact with the polishing pad. The conditioner disk 200, which will be discussed in detail below, is generally positioned at a bottom of the conditioner head 46 and can rotate around an axis 41. A bottom surface of the conditioner disk 200 can include conditioning formations, such as protrusions or cutting edges, that contact the surface of the polishing pad 32 during the conditioning process. During conditioning, both the polishing pad 32 and the conditioning disk 200 rotate, so that these protrusions or cutting edges move relative to the surface of the polishing pad 32, thereby abrading and retexturizing the surface of the polishing pad 32.

The conditioner head 46 includes mechanisms to attach the conditioner disk 200 to the conditioner head 46 (such as mechanical attachment systems, e.g., bolts or screws, or magnetic attachment systems) and mechanisms to rotate the conditioner disk 200 around the rotating axis 41 (such as drive belts through the arm or rotors inside the conditioner head). In addition, the conditioning system 40 can also include mechanisms to regulate the pressure between the conditioner disk 200 and the polishing pad 32 (such as pneumatic or mechanical actuators inside the conditioning head or the base). These mechanisms can have many possible implementations (and are not limited to those shown in FIG. 1). Suitable implementations may be found in U.S. Pat. Nos. 6,200,199 and 6,217,429, the entire disclosures of which are incorporated herein by reference.

Figure 2:
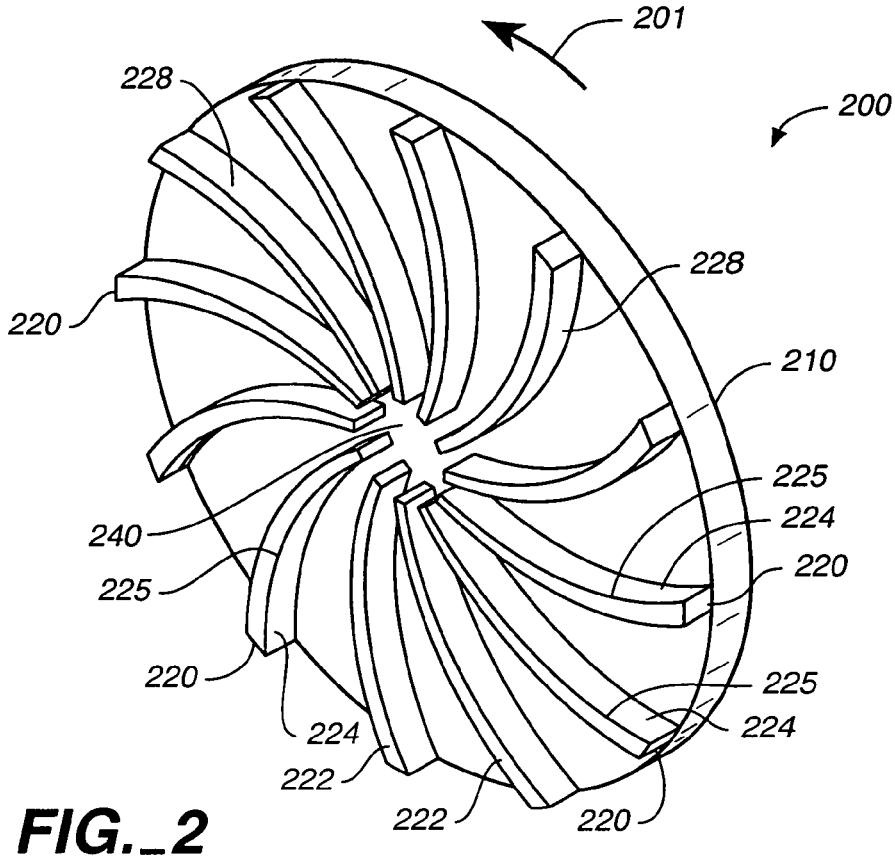
FIG. 2 shows a conditioner disk that includes curved blades positioned at the bottom of the conditioner disk.

Referring to FIG. 2, the conditioner disk 200 includes a base structure 210 in the form of a generally planar disk, and multiple curved blades 220 projecting from the bottom of the base structure 210. Each curved blade 220 extends generally in a radial direction and includes a bottom surface 222, a front surface 224, and a back surface 228. Each curved blade 220 also includes a sharp leading edge 225. All of the curved blades 220 can be identical in shape, or the blades 220 can have different shapes.

Each blade 220 can extend from a central region 240 (into which the blades do not extend) to the edge of the conditioner disk 200. Adjacent the center region 240 of the conditioner disk, the blades 220 can be oriented generally parallel toward the center of rotation of the conditioning disk, whereas at the outer edge of the conditioner disk, the blades can oriented such that the tangential of the curved blade forms an angle of about 0° to 60° to the radial direction going through the disk center and the outer tangential point.

Figure 3A:
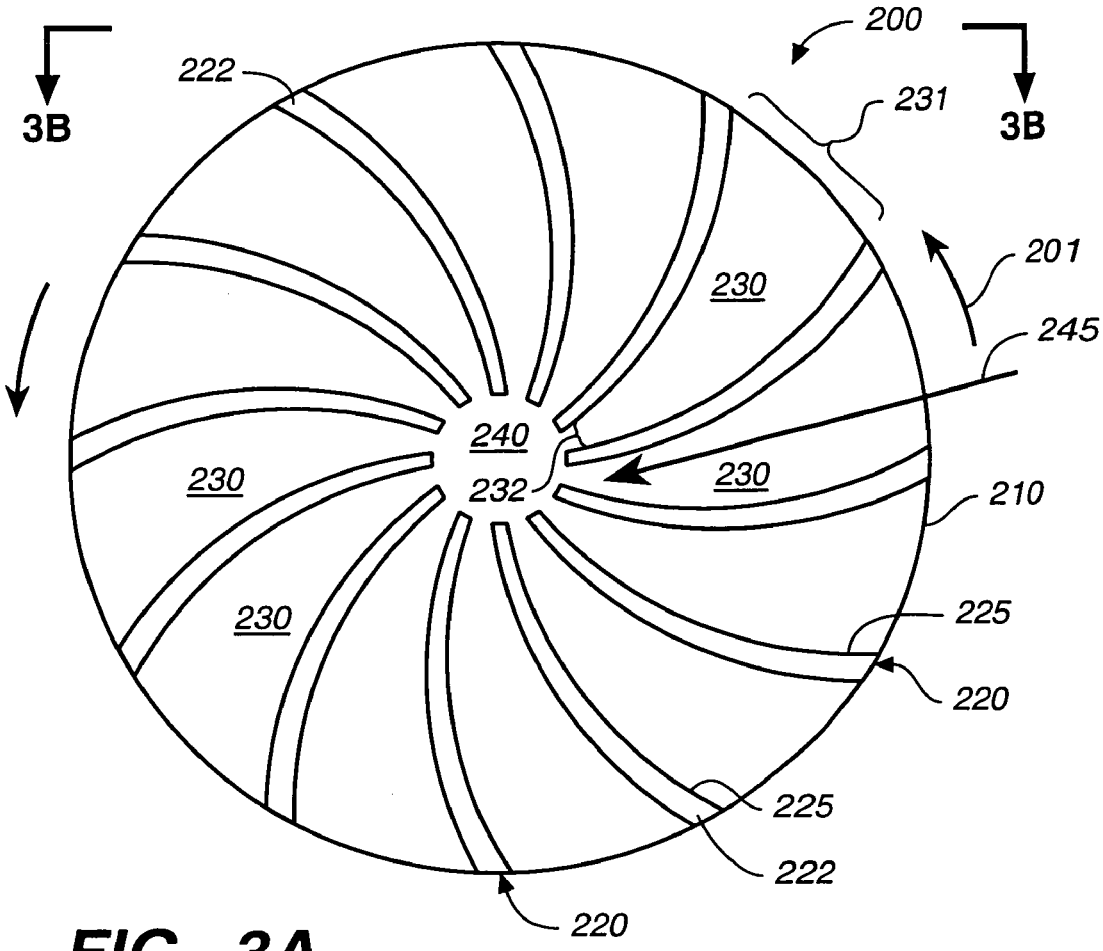
FIG. 3A shows a bottom view of the conditioner disk of FIG. 2.

As shown in FIG. 3A, each curved blade 220 can be designed such that the front surface 224 and the back surface 228 curve in the same tangential direction. In one implementation, all the curved blades 220 are positioned and aligned to curve generally in the same tangential direction, e.g., counterclockwise. Each pair of adjacent curved blades 220 can be positioned and aligned to curve generally in the same tangential direction to form a curved recess 230. The recess 230 is wider at the periphery of the conditioner disk 200 (at the outer opening 231 of the recess) than near the center of the conditioner disk 200 (at the inner opening 232 of the recess).

During conditioning, the conditioning disk 200 is moved into contact with the polishing pad and rotated. Each pair of adjacent curved blades 220 contact the polishing pad 32 so that the curved recess provides a pumping channel for slurry distribution. If the conditioner disk 200 rotates in the same tangential direction 201 as the curved blades 220, slurry 245 on the polishing pad at periphery of the conditioner disk 200 is captured and drawn inwardly to the center of the conditioner disk 200 though the pumping channels 230. The decreasing cross-sectional area of the pumping channels act as a funnel to increase the pressure of the slurry as it enters the center region 240 of the conditioner disk 200, causing the entrapped slurry near the center of the conditioner disk 200 to be driven into the open cell structures or grooves in the polishing pad 32 more effectively. Thus, the conditioning disk can aid in more uniform polishing slurry distribution.

In contrast, if the conditioner disk 200 rotates in a tangential direction 201 which is opposite to that of the curved blades 220, the pumping channels 230 act to suction the slurry 245 out of the open cell structures in the polishing pad at the center region 240 of the conditioner disk 200 and expel the slurry toward the periphery of the conditioner disk 200 or out of the conditioner disk 200 entirely. Thus, the conditioning disk can aid in removing slurry from the polishing pad during a rinse cycle (in which a cleaning fluid such as DI water is supplied to the polishing pad to rinse off slurry), and thereby improve the cleanliness of the polishing pad and reduce defects.

Figure 3B:
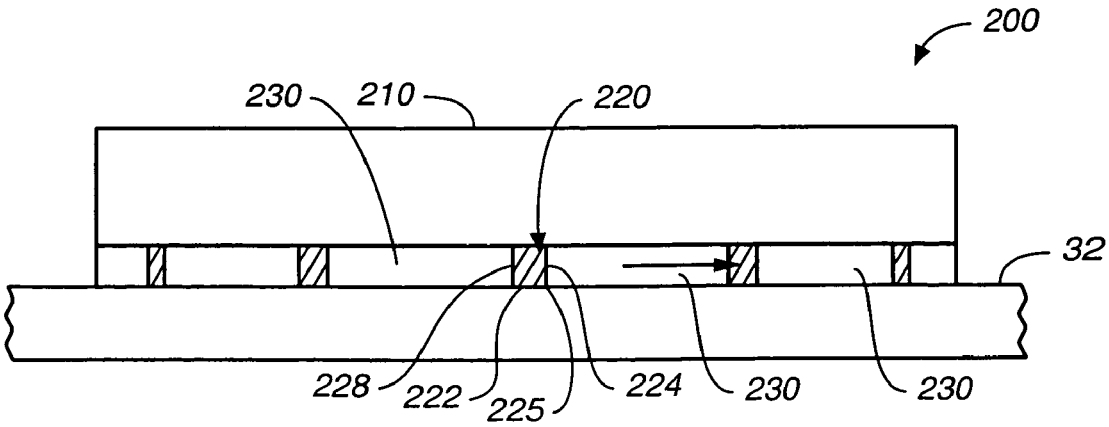
FIG. 3B shows a side view of the conditioner disk of FIG. 2 along line 3B-3B from FIG. 3A.

Referring to FIG. 3B, the curved blade 220 is positioned at the bottom of the conditioner disk 200 and supported by the base structure 210. The bottom surface 222 of the curved blade 220 engages the top surface of the polishing pad 32. In one implementation, shown in FIG. 3B, the front surface 224 of the curved blade 220 is essentially perpendicular to the bottom surface 222 of the curved blade 220. The leading edge 225 is defined between the front surface 224 and the bottom surface 222. As the edge 225 contacts and moves against the polishing pad 32, it abrades or gouges the polishing pad surface, thereby providing conditioning.

Figure 3C:
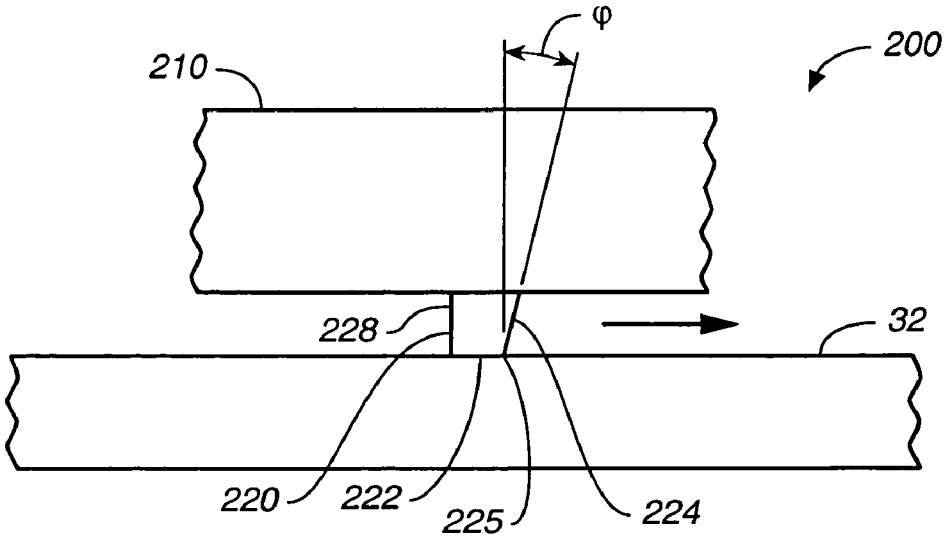
FIGS. 3C-3D each show a side view of an implementation of the conditioner disk.

In another implementation, shown in FIG. 3C, the front surface 224 inclines forward and forms a forward inclination angle $\phi$ with respect to a reference plane perpendicular to the bottom surface 222, i.e., the angle between the front surface 224 and the bottom surface 222 that contacts the polishing pad surface 32 is an acute angle. As shown in the figure, when the front surface 224 inclines forward, the front surface 224 is in front of the edge 225 with respect to the direction of travel.

Figure 3D:
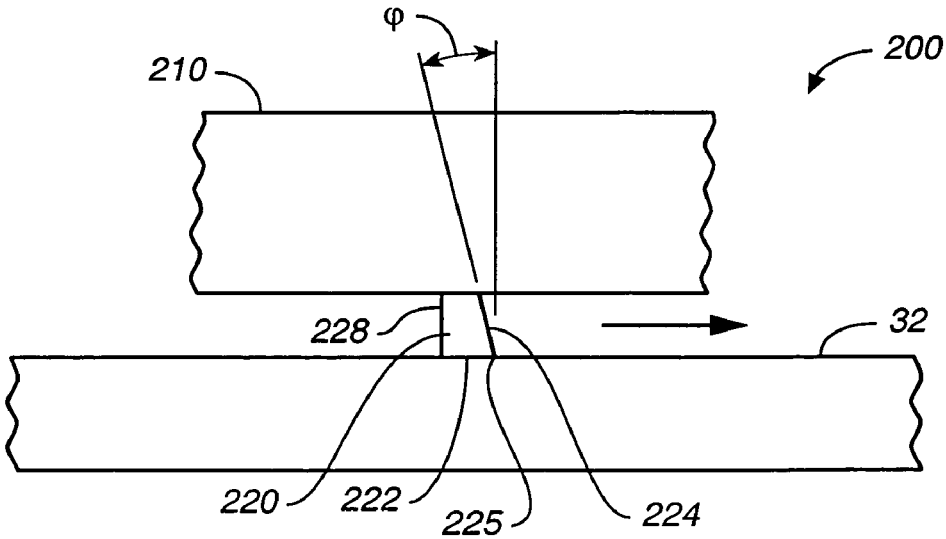

In another implementation, shown in FIG. 3D, the front surface 224 inclines backward and forms a backward inclination angle $\phi$ with respect to a reference plane perpendicular to the bottom surface 222, i.e., the angle between the front surface 224 and the bottom surface 222 that contacts the polishing pad surface 32 is an obtuse angle. As shown in the figure, when the front surface 224 inclines backward, the front surface 224 is behind the edge 225 with respect to the direction of travel.

In the implementations of FIGS. 3B-3D, the edge 225 can be in the form of a right angle or sharp edge. The edge 225 can also be modified, e.g., chamfered, to make the edge 225 more compatible with the conditioning process required for a given type of polishing pad material, e.g., fixed abrasive, woven cloth, or cast polyurethane.

Figure 4:
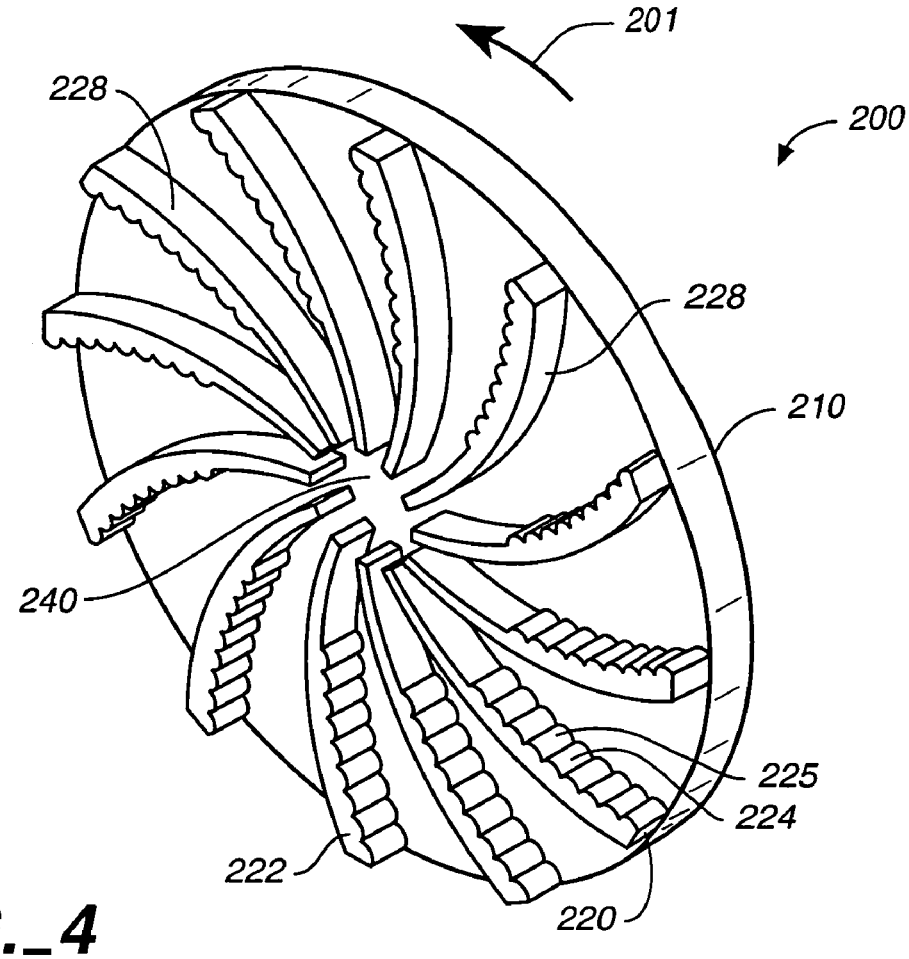
FIG. 4 shows an implementation of a conditioner disk having curved blades that include serrated edges.

In the implementations of FIGS. 3B-3D, the front surface 224 of the curved blade 220 can be planar. However, the front surface 224 can also be convex, concave, or have other shapes. In addition, the front surface 224 and/or the bottom surface 222 can be coated with a hardening material, such as diamond or a carbide, e.g., silicon carbide, titanium carbide or tungsten carbide. The front surface 224 and/or the bottom surface 222 can also include a serrated or knurled surface for forming multiple conditioning edge facets on the curved blade 220. FIG. 4 shows an implementation of the conditioner head in which the curved blades 220 include serrated edges on the front surfaces 224.

Figure 5A:
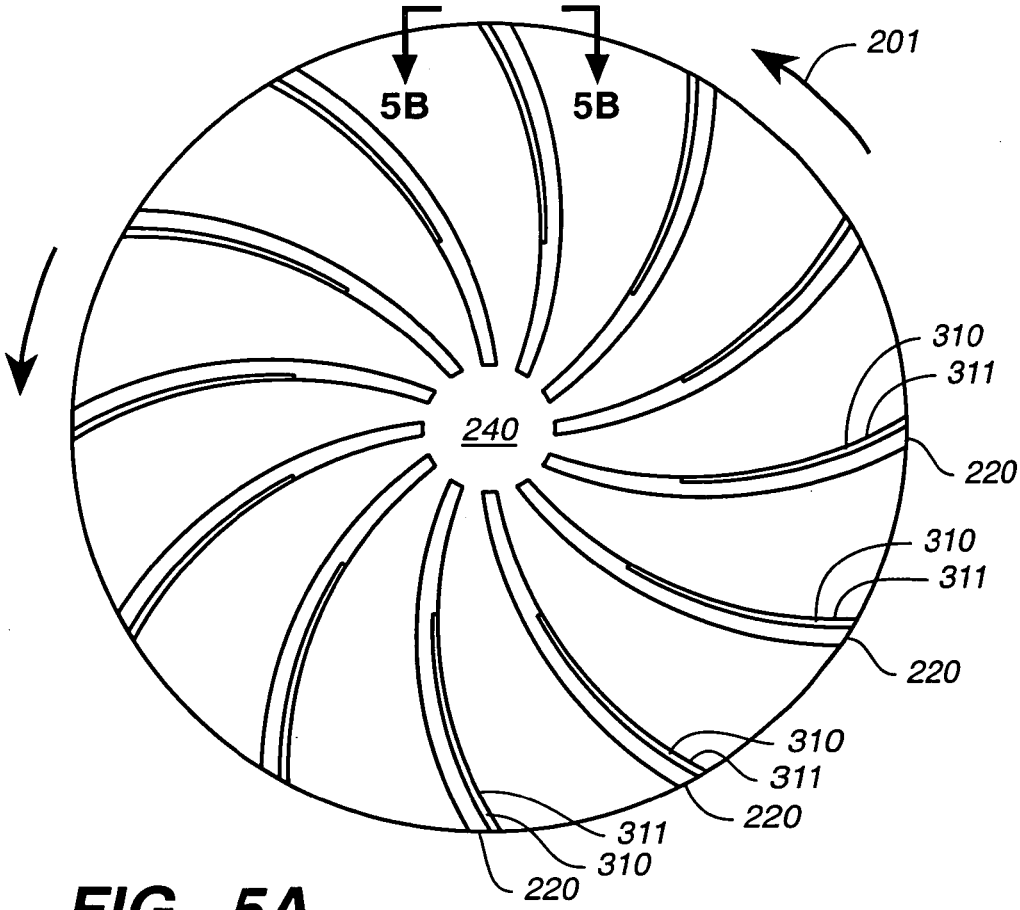
FIGS. 5A-5C show a conditioner disk that includes insert tool holders for holding insert tools.
Figure 5B:
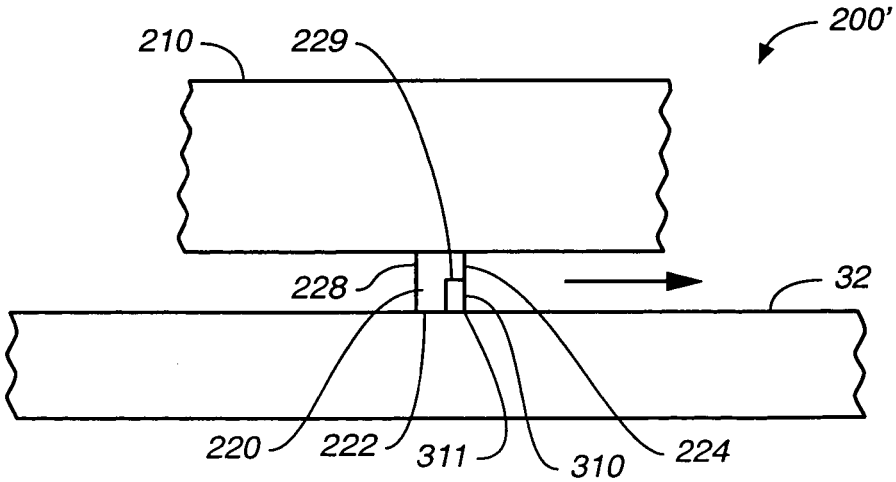
Figure 5C:
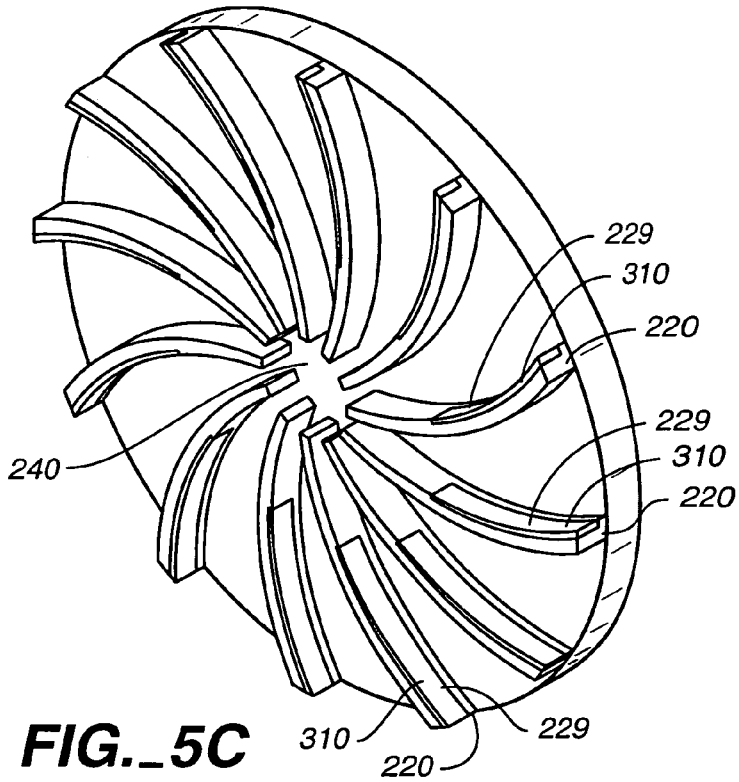

In another implementation, shown in FIGS. 5A-5C, the curved blade 220 can include an insert tool holder 229 for holding an insert tool 310 that provides the contact edges 311 for the conditioner disk. The insert tool 310 can be held on the conditioning disk by conventional mechanisms, such as screws, adhesive, or press fitting. The contact edge 311 can be in the same plane as the bottom surface 222 of the blade, or they can also extend beyond the bottom surface 222. In addition, the distance that the contact edge 311 extends beyond the bottom surface 222 can be adjustable, e.g., with an adjustment screw.

Figure 6:
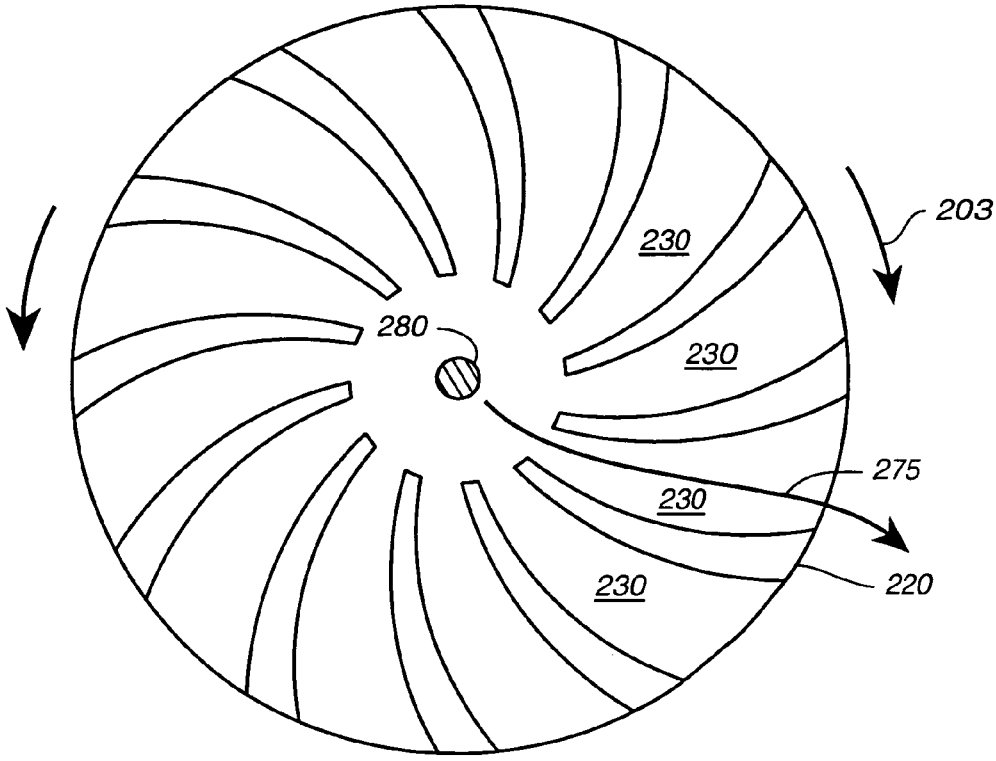
FIG. 6 shows a conditioner disk that includes a passage for introducing cleaning fluids to areas near the center of the conditioner disk.

In yet another implementation, shown in FIG. 6, the conditioner disk 200 can also include a passage 280 for introducing a cleaning fluids, such as deionized water, to areas near the center of the conditioner disk 200. The passage 280 can be positioned at or near the center of the conditioner disk 200, such as in the central region 240 into which the blades do not extend. The cleaning fluid introduced from the passage 280 will flow into channels 230 near the center of the conditioner disk 200. When the conditioner disk 200 rotates in a tangential direction 203 opposite that of the blades 220, the cleaning fluid 275 near the center of the conditioner disk 200 can be driven out of channels 230 from the peripheral area of the conditioner disk 200.

Parts in the conditioner disk 200 can be constructed from stainless steel, a carbide, or some combination thereof. In addition, parts in the conditioner disk can also be constructed from a hard polymer, for example, a polyphenyl sulfide (PPS), a polyimide such as Meldin, a polybenzimidazole (PBI) such as Celazole, a polyetheretherketone (PEEK) such as Arlon, a polytetrafluoroethylene (PTFE) such as Teflon, a polycarbonate, an acetal such as Delrin, or an polyetherimide (PEI) such as Ultem.

The materials selected for constructing the conditioner disk 200 generally depend on the construction material of the polishing pad 32. The preferred surface characteristics of the blades 220 generally also depend on the construction material of the polishing pad 32. For example, when the construction material of the polishing pad 32 is polyurethane (e.g., materials provided by Rodel under trade name IC1000 or IC1010), all surfaces of the blades 220 that need to contact with the surface of the polishing pad 32 are preferably coated with diamond particles. The grit size of the diamond coating can be in the range from 60 to 120 grit. The diamond coating on the blades 220 can also be treated additionally to protect the diamond coating in low pH or corrosive environment.

The surface characteristics of the blades 220 can also be modified to make the blades 220 more effective during conditioning process. For example, the blades 220 on the conditioner disk 200 can be constructed and machined from silicon carbide, and the surfaces of the blades 220 can coated with or transformed into amorphous diamond surfaces using currently know surface treatment process.

The present invention has been described in terms of a number of embodiments. The invention, however, is not limited to the embodiments depicted and described. Rather, the scope of the invention is defined by the appended claims.

What is claimed is:

1. A conditioner for use on a polishing pad in a chemical mechanical polishing process, comprising:

a base structure having an axis of rotation; and a plurality of curved blades supported by the base structure, the blades radiating outwardly from a center region of the base structure and curving in a common direction, each curved blade having at least a bottom and a top, wherein the top is connected to the base structure and the bottom is configured to contact a polishing pad and is wider than the top, each curved blade having a sharp leading edge configured to abrade without using abrasive particles a surface of a cast polyurethane polishing pad.

2. The conditioner of claim 1, wherein the base structure is disk-shaped.

3. The conditioner of claim 1, wherein the common direction is counter-clockwise as viewed from a side of the base structure with the blades.

4. The conditioner of claim 1, wherein the common direction is clockwise as viewed from a side of the base structure with the blades.

5. The conditioner of claim 1, wherein adjacent the center region, each blade is oriented parallel to a corresponding radius extending outwardly from the axis of rotation.

6. The conditioner of claim 1, wherein at an outer circumference of the conditioner, each blade is oriented such that the tangent of a surface of the blade forms an angle between about 0° and 60° with a corresponding radius extending outwardly from the axis of rotation.

7. The conditioner of claim 1, wherein the blades are distributed at equal angular intervals about the axis of rotation.

8. The conditioner of claim 1, wherein adjacent blades of the plurality of blades form a channel that is narrower near the center region than at an edge of the conditioner.

9. The conditioner of claim 8, wherein when the conditioner disk rotates in the common direction and the adjacent curved blades contact a surface of the polishing pad, each channel between adjacent curved blades captures slurry in an area near a periphery of the conditioner disk and directs the captured slurry to the center region.

10. The conditioner of claim 8, wherein when the conditioner disk rotates opposite to the common direction and the adjacent curved blades contact a surface of the polishing pad, the channel between adjacent curved blades expels slurry from the center region and directs the expelled slurry to an area at the periphery of the conditioner disk.

11. The conditioner of claim 1, wherein each blade includes a back surface and a front surface.

12. The conditioner of claim 11, wherein at least one of the back surface or front surface is inclined.

13. The conditioner of claim 12, wherein the front surface inclines forward and forms a forward inclination angle with a reference plane perpendicular to the bottom.

14. The conditioner of claim 12, wherein the front surface inclines backward and forms a backward inclination angle with a reference plane perpendicular to the bottom.

15. The conditioner of claim 11, wherein at least one of the bottom, the back surface, or the front surface are coated with a hardening material.

16. The conditioner of claim 15, wherein the hardening material is diamond.

17. The conditioner of claim 11, wherein an edge between the bottom and one of the back surface and the front surface is chamfered.

18. The conditioner of claim 17, wherein the bottom and portions of the back or front surfaces are coated with diamond abrasive grit.

19. The conditioner of claim 17, wherein the bottom of each blade is coated with diamond grit.

20. The conditioner of claim 17, wherein surfaces of each blade that can contact the polishing pad are coated with diamond grit.

21. The container of claim 11, wherein at least one of the bottom, the back surface, or the front surface are serrated.

22. The conditioner of claim 11, wherein at least one of the bottom, the back surface, or the front surface are knurled.

23. The conditioner of claim 1, further comprising an insert tool holder to hold an insert that forms a portion of at least one of the blades.

24. The conditioner of claim 1, wherein surfaces of each blade that can contact the polishing pad are coated with diamond grit.

25. The conditioner of claim 1, wherein the bottom of each of the blades is free of a particle coating.

26. The conditioner of claim 25, wherein the front surface inclines forward and forms a forward inclination angle with a reference plane perpendicular to the bottom surface.

27. The conditioner of claim 1, further comprising a passage near the center region of the base structure.

28. A conditioner for use on a polishing pad in a chemical mechanical polishing process, comprising:

a base structure having an axis of rotation; and a plurality of curved blades supported by the base structure, the blades radiating outwardly from a center region of the base structure and curving in a common direction, each curved blade having at least a bottom surface, a front surface or a leading surface configured to abrade a surface of a cast polyurethane polishing pad and a back surface, wherein at least one of the back surface or front surface is inclined and at an angle other than a right angle with respect to a surface of the base structure that is perpendicular to the axis of rotation and a cross section of the blade forms a trapezoid.

* * * * *

UNITED STATES PATENT AND TRADEMARK OFFICE

CERTIFICATE OF CORRECTION

PATENT NO. : 7,367,872 B2
APPLICATION NO. : 10/409888
DATED : May 6, 2008
INVENTOR(S) : Timothy J. Donohue It is certified that error appears in the above-identified patent and that said Letters Patent is hereby corrected as shown below:

Column 8, Line 10 at Claim 21; replace:

"The container of claim 11, wherein at least one of the" with

-- The conditioner of claim 11, wherein at least one of the --

Signed and Sealed this

Fifth Day of August, 2008

JON W. DUDAS
*Director of the United States Patent and Trademark Office*